United States Patent [19]

Murata

[11] 4,263,666

[45] Apr. 21, 1981

[54] DEVICE FOR CORRECTING DIGITAL DISPLAY USED IN ELECTRONIC TIMEPIECES

[75] Inventor: Mitsuhiro Murata, Tokyo, Japan

[73] Assignee: Citizen Watch Co., Ltd, Tokyo, Japan

[21] Appl. No.: 947,364

[22] Filed: Oct. 2, 1978

[30] Foreign Application Priority Data

Sep. 30, 1977 [JP] Japan ..... 52-118094
Jun. 23, 1978 [JP] Japan ..... 53-76198

[51] Int. Cl.[3] ..... G04C 9/00

[52] U.S. Cl. ..... 368/187; 368/188; 368/82; 368/239

[58] Field of Search ..... 58/58, 89.5, 63, 64, 58/65, 73, 88 B, 90 B, 23 R; 200/4, 6 R; 368/184–189, 62, 82–84, 239–242

[56] References Cited

U.S. PATENT DOCUMENTS 4,135,359 1/1979 Yajima ..... 58/23 R

*Primary Examiner*—Ulysses Weldon
*Attorney, Agent, or Firm*—Sherman & Shalloway

[57] ABSTRACT

A device for correcting the contents of a display, which is used in electronic timepieces equipped with a display for indicating day, date, hour and minute, including a stem which has a crown at a tip portion thereof and is capable of being moved between three stable positions. In the first position, the stem is in its most axially inserted position. At a second position, in which the stem is withdrawn by one step from the most inserted first position, the stem is allowed to turn in both the right and left directions by a suitable angle. At a third position in which the stem is further pulled by one step from the second position, it may also be turned, by an appropriate angle, in both directions. The movement of the stem in the axial direction is detected by a first switch means, and the rotation of the stem at the second and third positions is detected by a second switch means, whereby any one of the four display items is corrected depending upon the state of the two switch means.

12 Claims, 10 Drawing Figures

DEVICE FOR CORRECTING DIGITAL DISPLAY USED IN ELECTRONIC TIMEPIECES

BACKGROUND OF THE INVENTION

1. Field of the Invention:

The present invention relates to a device for correcting any one of a plurality of elements displayed in a display of an electronic timepiece. The contents of the display may include, for example, numerical figures or characters for indicating day, date, hour and minute, and may further include numerical figures or characters for indicating year and month.

2. Prior Art:

Some information associated with time, such as the display of day, date, hour and minute, can be corrected by feeding correcting pulses to the mechanism which stores the information, typically, by feeding correcting pulses to a counter. As a means for feeding correcting signals, a conventional correcting device is equipped with a first push-button switch for selecting the content of display that is to be corrected, and a second push-button switch for feeding correcting signals. Although the correcting device of this type requires simple operation for effecting the correction, it presents complicated combinations in regard to the order of pushing the two push buttons and the number of times for pushing the buttons, causing users to encounter difficulties in properly understanding the operation. Further, the greatly different order of operation from the operations of the conventional timepieces presents an unfamiliar feeling to the users, making the timepiece itself less desirable.

A correcting device of another type is comprised of a stem which is capable of being moved between at least three positions in the axial direction and which is also capable of being rotated by a suitable angle in both the right and left directions about its axis, and a crown mounted on the end of the stem. The display portion to be corrected is selected by pulling the crown from the first position to the second position; or by further pulling the crown from the second position to the third position and by rotating the crown in the right or left direction by a required angle at the second position or the third position. The correcting device of this type requires a correcting operation similar to that of conventional timepieces, and is easily accepted by users. To attain such an operation, however, it is necessary to provide two sets of switches in narrow spacing defined by the moving distance of the stem between the second and third positions, with resultant restrictions on the size of contacts constituting the switches. Such small switches require clumsy assembling operations and lack a desired durability.

SUMMARY OF THE INVENTION

According to the present invention, there is provided a correcting device for a digital display-type electronic timepiece which is so constructed that predetermined objects for correction are selectively corrected by the combination of a position to which the crown is pulled and at the direction of rotation of the crown, said time-correcting device comprising a first switching means which is interlocked to the movement of said crown in the axial direction, and a second switching means which makes or breaks the circuit depending upon the rotation of the crown in either the right direction or the left direction, wherein the objects for correction that will be corrected by the turn of the crown are selected in combinations of two objects by means of said first switching means, and wherein one of the two objects thus selected is corrected independent of the other by means of said second switching means; depending upon the turn of the crown in either the right direction or the left direction.

Briefly, the correcting device according to the present invention has two switch means that are independent from each other. The first switch means detects the axial position of the stem, and the second switch means detects the rotating direction of the stem. The two switch means can be provided at suitable positions irrespective of the range of the movement of the stem in the axial direction; therefore, no limitation in size is imposed to the contact points of the switch means.

Furthermore, the correcting device of the present invention includes a means which, when the stem is pulled to the second position or the third position, retains the display portion that are to be corrected at their respective positions while deenergizing all other displays, and which further indicates in which direction the crown should be turned to correct the retained display portion. The change of display indicates the position at which the stem is located, and further indicates the direction in which the stem should be turned, which is necessary to correct the desired display portion and, therefore, helps to prevent any possible erroneous correction.

In addition, the correcting device of the present invention has a means for discriminating the state in which the stem is pulled from the second position to the third position and the state in which the stem is pushed back from the third position to the second position, as well as a means which, when it is receiving an output from the discriminating means, produces a correcting signal different from a correcting signal that is produced when it is not receiving the output from the discriminating means. That is, a maximum of six kinds of displays can be corrected without needing to change any mechanical elements.

BRIEF DESCRIPTION OF THE DRAWINGS

FIGS. 1 (*b*), 2 (*b*) and 3 (*b*) are plan views showing the positions of the stem under the states of FIGS. 1 (*a*), 2 (*a*) and 3 (*a*), and the states of the two switch means;

DETAILED DESCRIPTION OF THE PREFERRED EMBODIMENTS

Figure 1A:
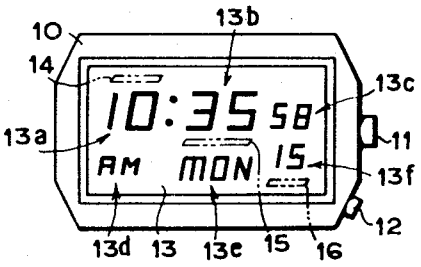
FIG. 1 (*a*) is a front view of an electronic timepiece equipped with a correcting device according to the present invention, in which the digital display is one when the crown is located at the first position.
Figure 1B:
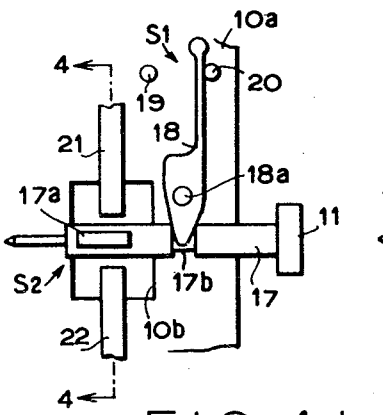

FIG. 1(*a*) shows an electronic timepiece equipped with a correcting device of the present invention and having a watch case 10 for accomodating an ordinary timepiece mechanism and the correcting device. The case 10 is further equipped with a crown 11, a push button 12 that is to be pushed when it is desired to reset the second to zero, and a digital display 13. The display 13 comprises a display portion 13*a* for displaying the hour, a display portion 13*b* for the minute, a display portion 13*c* for the second, a display portion 13*d* for the morning and afternoon by means of two sets of characters "AM" and "PM", a display portion 13*e* for the day in the combination of three characters, and a display portion 13*f* for the date, and is composed, for example, of liquid crystal cells. In this example, the display 13 is displaying 35 minutes and 58 seconds past 10 o'clock, a.m. of Monday, 15th day. Further, when the crown is located at the first position at which it is pushed back home, the display 13 has three bar-like display portions 14, 15 and 16 which are in a deenergized state, in which the display portion 14 is located above the display portion 13*a*, the display portion 15 is between the display portion 13*b* and the display portion 13*e*, and the display portion 16 is below the display portion 13*f*.

The crown 11, as shown in FIG. 1(*b*), is attached to the tip of a stem 17 which is supported by the case 10 to be movable in the axial direction between the three stable positions. There are provided a suitable stopper and a click-stop mechanism, which are not shown, to hold the stem 17 at any one of the three stable positions. Reference numeral 18 represents a lever or a moving contact supported by a pin 18*a* which is studded on a base plate 10*a*; the moving contact 18 constitutes a first switch means $S_1$ together with fixed contacts, i.e., contact pins 19 and 20 that are planted on the base plate 10*a* with maintaining a predetermined distance with respect to each other. One end of the moving contact 18 is located in a groove 17*b* formed in the stem 17, such that the moving contact 18 is caused to turn about the pin 18*a* when the stem 17 is moved in the axial direction. That is, when the stem 17 is located at the first position (FIG. 1(*b*)), the moving contact 18 is located at such a position that its one end is in contact with the contact pin 20. When the stem 17 is pulled from the first position to the second position (FIG. 2(*b*)), the end of the moving contact 18 is located at an intermediate position between the contact pins 19 and 20. Further, when the stem 17 is pulled from the second position to the third position (FIG. 3(*b*)), the end of the moving contact 18 comes into contact with the contact pin 19.

Figure 4:
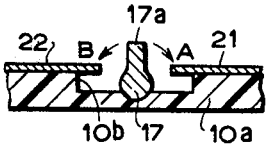
FIG. 4 is a cross-sectional view along line 4—4 of FIG. 1 (*b*)

A recess 10*b* with a suitable depth is formed in the base plate 10*a*, and the stem 17 extends to traverse the recess 10*b*, the stem 17 having a projection 17*a* which is located above the recess 10*b*. Further, a pair of contacts 21 and 22 composed of resilient strip members and fastened to the base plate 10*a* extend along the plane of the opening of the recess 10*b* up to the vicinity of the stem 17. These contacts 21 and 22 constitute a second switch means $S_2$ which comes into contact with the projection 17*a* when the stem 17 is turned in the clockwise direction (indicated by an arrow A) in FIG. 4 or in the counterclockwise direction (arrow B) respectively.

Figure 5:
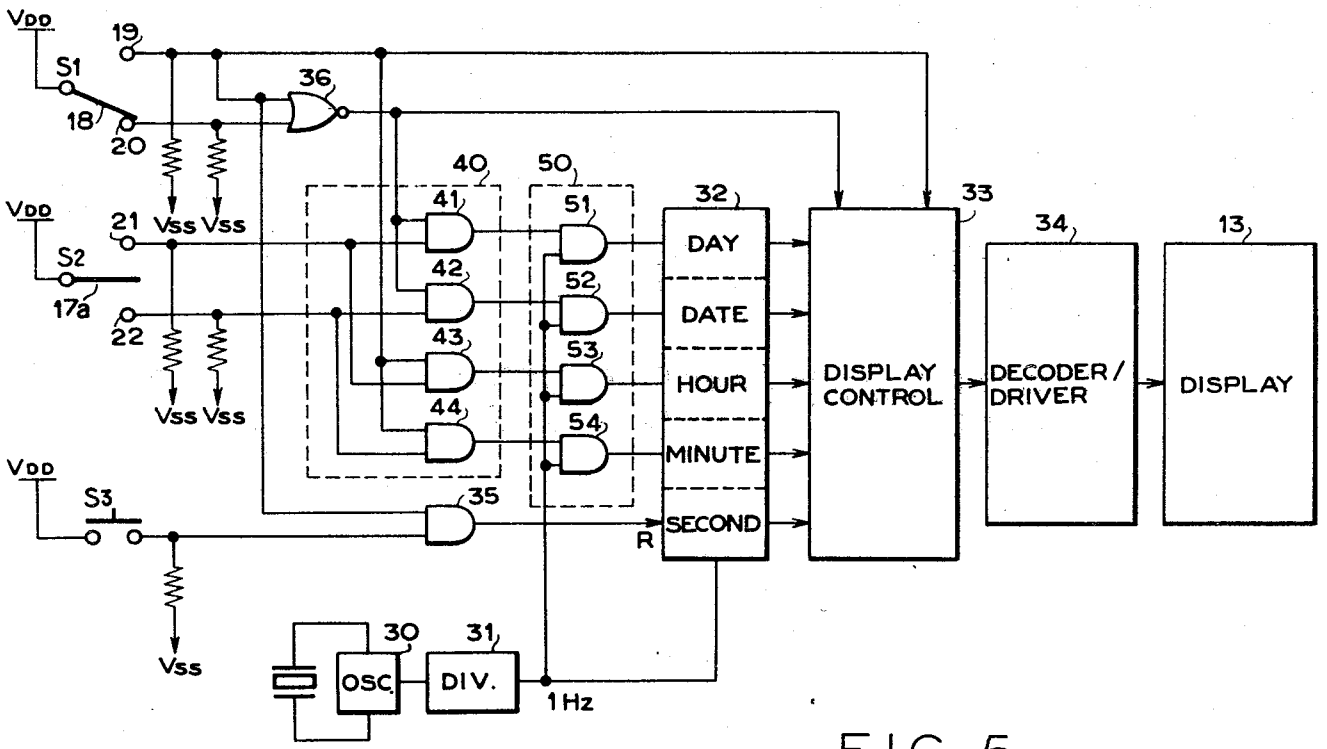
FIG. 5 is a circuit diagram of the correcting device installed in the timepiece of FIG. 1 (*a*)

FIG. 5 shows an embodiment of the correcting device provided in the timepiece shown in FIG. 1(*a*).

In FIG. 5, reference numeral 30 denotes a quartz oscillator circuit, 31 a frequency-divider circuit, and 32 a time counter consisting of a series of counters for seconds, minutes, hours, dates and days counter. The output of the time counter 32 is fed to a decoder/driver circuit 34 via a display control circuit 33 to drive a liquid crystal display device 13. The contact pin 19 of the first switch means $S_1$ is connected to the input terminals on one side of an AND-gate 35 and a NOR-gate 36, and, to the input terminals on one side of AND-gates 43 and 44 constituting a group of gates 40 for selecting the correcting display objects for correction, and to the display control circuit 33. The contact pin 20, on the other hand, is connected to the input terminal on the other side of the NOR-gate 36. The output end of the NOR-gate 36 is connected to the input terminals on one side of AND-gates 41 and 42 of the gate group 40 and to the display control circuit 33. The abovesaid contacts 21 and 22 of the second switch means $S_2$ are connected to AND-gates 41, 43 and 42, 44, respectively of the gate group 40 for selecting the correcting objects as shown, and the output end of said AND-gates 41 to 44 are connected to the input terminals on one side of AND-gates 51 to 54 constituting a gate group 50 to which are introduced correcting signals. To the input terminals on the other side of AND-gates 51 to 54 is supplied a 1-Hz signal produced by the frequency-divider circuit 31, and the output terminals of AND gates 51 to 54 are connected to the correcting signal input terminals of the corresponding counters of the time counter 32.

A switch $S_3$ for resetting the second to zero, which is opened and closed by means of the button 12, is connected to the input terminal on the other side of AND gate 35. The output terminal of AND gate 35 is connected to a reset terminal R of the second counter of the time counter 32.

The operation of the time correcting device according to the embodiment will be described below. The circuit according to this embodiment operates based on the principle of the positive logic in which the symbols "H" and "L" indicate that the circuit is logically in a high level and a low level, respectively.

First, referring to FIGS. 1(*a*) and 1(*b*), when the crown 11 is located at a home position at which it is most deeply pushed back, the moving contact 18 is in contact with the contact pin 20. In this state the contact pin 19 and the output end of the NOR-gate 36 are in the "L" level, whereby AND-gates 41 to 44 of gate group 40 for selecting the correcting objects and the AND-gate 35 are all closed. Therefore, even if the crown 11 under this state is turned to bring the projection 17*a* into contact with the contact springs 21, 22, or even if the switch $S_3$ for resetting the second at zero is closed, the correction of display is not at all effected, so that the normal state of display is maintained.

Figure 2A:
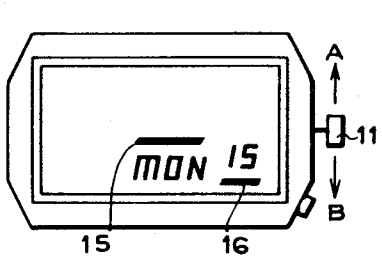
FIG. 2 (*a*) and FIG. 3 (*a*) are front views of the timepiece of FIG. 1 (*a*), showing display surfaces when the crown is located at the second position and the third position, respectively.
Figure 2B:
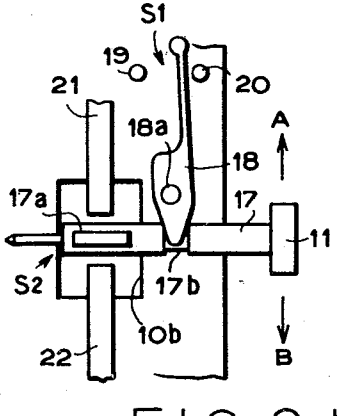

Next, as shown in FIGS. 2(*a*) and 2(*b*), when the crown 11 is located at the second position, the moving contact 18 comes into contact with neither the contact pin 19 nor the contact pin 20. The contact pin 20 acquires the "L" level and the output end of the NOR-gate 36 acquires the "H" level, whereby the AND-gates 41 and 42 among said selection gate group 40 are enabled so that the date and day are selected as objects for correction. At the same time, the display control circuit 33 receives the output of the NOR-gate 36, whereby the display portions for hours, minutes and seconds are deenergized, and the dates and days are selected as objects for correction, and further the display portions 15 and 16 are turned on to indicate the direction in which the crown should be rotated. As indicated by the display portions 15 and 16, therefore, when the crown 11 in this state is turned in the direction A, the day is corrected, and when the crown 11 is turned in the direction B, the date is corrected independent of each other. That is, when the projection 17*a* is brought into contact with the contact 21, the AND-gate 51 is activated, or opened, and when the projection 17*a* is brought into contact with the contact 22, the AND-gate 52 is opened, permitting the 1 Hz correcting signal to be supplied to the corresponding counters of day and date.

Figure 3A:
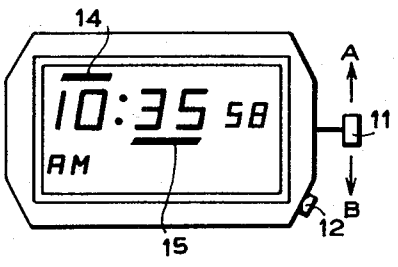
Figure 3B:
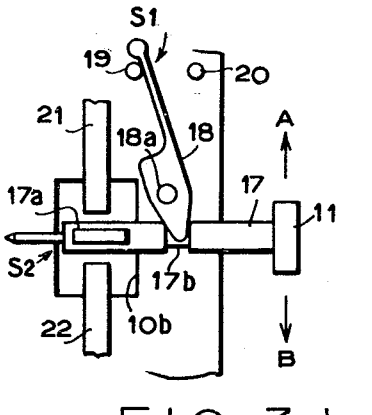

Further, when the crown 11 is located at the third position as shown in FIGS. 3(*a*) and 3(*b*), the contact pin 19 acquires the "H" level and the output side of the NOR-gate 36 acquires the "L" level. As the result, the AND-gates 43 and 44 of said selection gate group 40 are enabled whereby the hour and minute are selected as objects for correction, and the display of date and day are erased by the display control circuit 33, and the display portions 14 and 15 are energized to indicate the directions in which the crown should be turned. In this case, also, the hour is corrected when the crown 11 is turned in the direction A, and the minute is corrected when the crown 11 is turned in the direction B independent of each other, as indicated by the display portions 14 and 15. That is, where the crown 11 is turned in the direction A, the projection 17*a* comes into contact with the contact 21 causing the output end of the AND-gate 43 to acquire the "H" level, so that the AND-gate 53 is opened to feed the 1 Hz correcting signal to the hour counter. Whe the crown 11 is turned in the direction B the minute counter is corrected by way of the same function. Further, the AND-gate 35 will be opened only when the crown is pulled by two steps. Therefore, if the switch $S_3$ for resetting the second to zero is closed, the second counter is reset causing the second display to be reset to zero. That is, the abovesaid first switch means $S_1$ also works as a safety lock switch for preventing erroneous operation that may be caused by the switch $S_3$ which is used for resetting the second to zero.

Therefore, according to the abovementioned setup, it is made possible to correct the display of time by the operation which is very close to the operation of a crown of the conventional hand display-type wrist watches. Further, since the selected objects for correction are indicated at each position at which the crown is pulled out, the probability that the user may erroneously correct the time is eliminated. Comparing the correcting device of this embodiment with a conventional correcting device, the minute, hour, date and day are corrected by means of the four switches in either case. With the conventional device, however, it was necessary to provide an additional switching contact if it was intended to indicate the selected objects for correction so that the positions of the crown could be confirmed. Furthermore, with the correcting device of this embodiment, it is necessary that only one contact spring be provided for each of the clockwise rotation or counterclockwise rotation of the crown; therefore, there is no need of arraying the switching contacts at the very small distance that is defined by the pulling stroke of the crown of the conventional device.

As mentioned above, the present invention is to construct a correcting device comprising a first switch means, which operates by being interlocked to a position at which the crown is pulled out, and a second switch means which makes or breaks a circuit depending upon the rotation of the crown, wherein two objects for correction are selected by the first switch means, and either one of the two objects for correction is corrected independent of the other by means of the second switch means, depending upon in which direction (clockwise or counterclockwise) the crown is turned.

Although the display portions 14, 15 and 16 for indicating the direction in which the crown should be rotated are provided in the abovementioned embodiment to show the relation between the objects for correction at each position at which the crown is pulled out and the rotating direction of the crown, it is also possible to connect a timer to the second switching means instead of providing the display portions, so that when the crown is rotated, the objects for correction are so flashed for the first several seconds that the user may recognize it and then the correcting signals are supplied to the counters constituting the time counter. Moreover, according to the present invention, it is also possible to reset the seconds count to zero by turning the crown at its ordinary position without at all providing an additional switch for resetting the count to zero. In this case, there is no need of providing an additional switching contact, either.

The present invention is also applicable to timepieces which are so constructed that part of the display device is switched to display other information. An example is briefly mentioned below.

For example, as a modification of the embodiment of FIGS. 1 to 5, the timepiece may be so constructed within the scope of the present invention that the dominical year is displayed using four digits of the display portions 13*a* and 13*b* which usually display the hour and minute, and the month is displayed using two digits of the second display. According to such timepiece, when the crown 11 is located at the first position, the year and month can be displayed for a predetermined period of time if the switch $S_3$ is closed, and can also be corrected when the crown 11 is turned within that period of time by pulling it to the second position or the third position. The same holds true even when the timepiece is equipped with an additional function such as alarm function; if the switch $S_3$ is turned on with the crown 11 at the first position, the display is switched to display the time at which the alarm is set. Further, if the crown 11 is pulled out with the display thus being switched, the hour and minute for producing the alarm can be corrected. Moreover, by utilizing the second position and the third position of the crown 11, it is possible to set two alarms. The setups similar to the abovementioned construction can further be devised even when a plurality of additional functions are to be sequentially switched and displayed by means of the switch $S_3$.

Figure 6:
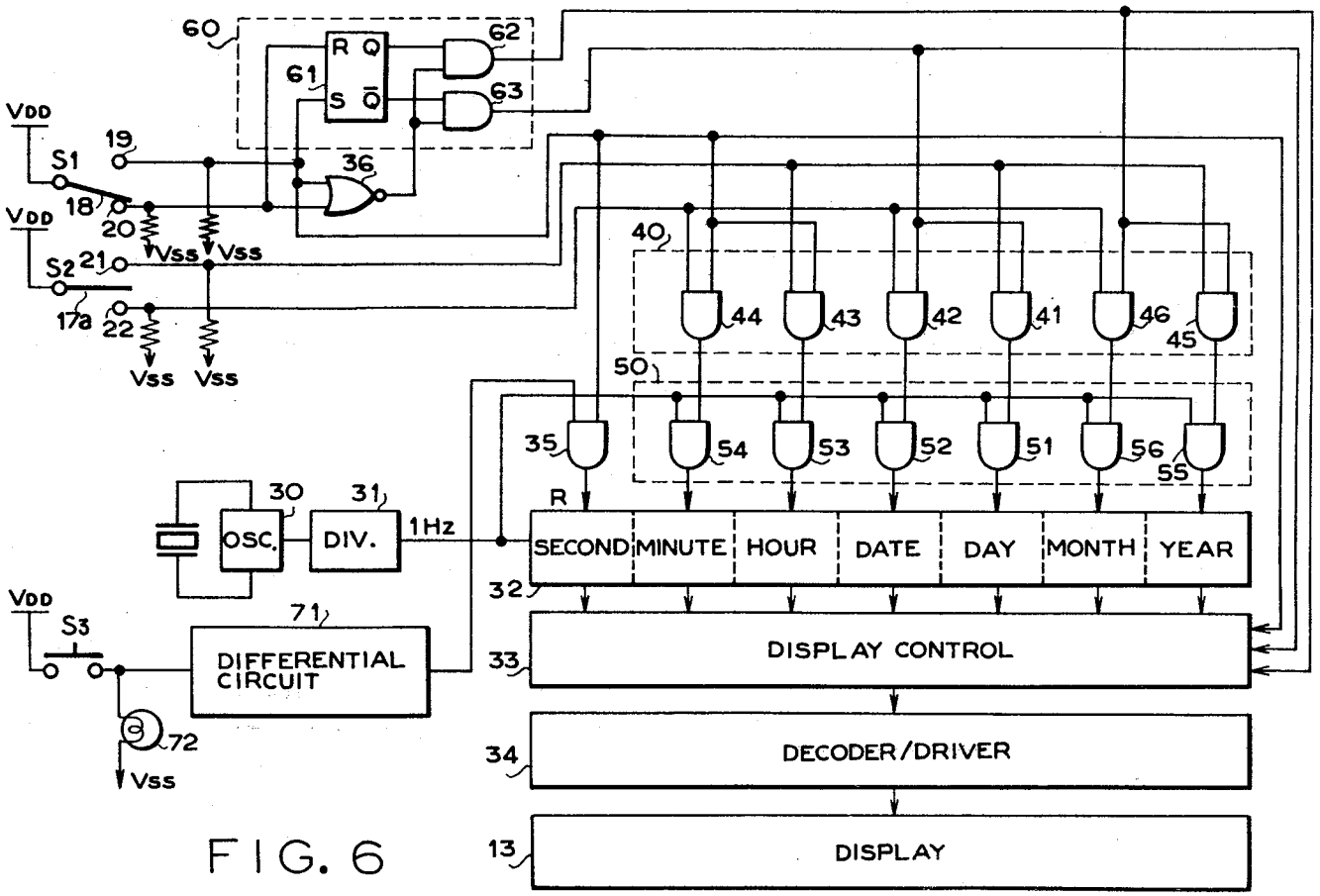
FIG. 6 is a circuit diagram of another correcting device according to the present invention.

FIG. 6 shows a correcting device that will be applied to a timepiece having such a function that when an external operation member is operated, the numerals for indicating the year are displayed by the display portions 13*a* and 13*b* of FIG. 1(*a*), and the numerals for indicating the month are displayed by the display portion 13*f*. In FIG. 6, the same or equivalent portions are those of FIG. 5 are designated by the same reference numerals. In this embodiment, the time counter 32 includes additional counters of the year and month, the selection gate group 40 includes additional AND-gates 45 and 46, and the correcting signal input gate group 50 possesses additional AND-gates 55 and 56.

The discriminating circuit 60, on the other hand, possesses a flip-flop 61 and a pair of AND-gates 62 and 63. A set input terminal of the flip-flop 61 is connected to the contact pin 19, a reset input terminal thereof is connected to the contact pin 20, the output terminals Q and $\overline{Q}$ are connected to the input terminals on one side of the AND-gates 62 and 63, and the input terminals on the other side of the AND-gates 62 and 63 are commonly connected to the output terminal of the NOR-gate 36. The output terminal of the AND-gate 62 is connected to the input terminals on one side of the AND-gates 45 and 46, and the output terminal of the AND-gate 63 is connected to the input terminals on one side of the AND-gates 41 and 42. The output signals of the AND-gates 45 and 46 are used to enable the AND-gates 55 and 56. When the AND-gates 55 and 56 are being turned on, a 1 Hz correcting signal from the frequency-divider circuit 31 is supplied to the year counter and the month counter thereby to correct the year and the month.

There is further provided a differentiation circuit 71 for generating a pulse when the switch means $S_3$ is turned on; the pulse is fed to the reset input terminal of the second counter via the AND-gate 35. In this embodiment, the switch means $S_3$ also works as a lamp switch to energize a lamp 72 while it is being pushed, and the lamp 72 illuminates the surface of the display 13.

When the crown 11 is pulled out from the first position to the second position, the moving contact 18 comes into contact with neither the contact pin 19 nor the contact pin 20 as shown in FIG. 2(*b*). As a result, the contact pins 19 and 20 acquire the "L" level, and the output end of the NOR-gate 36 acquires the "H" level. Here, since the flip-flop 61 is maintained in a reset state which was attained in the first position, when moving contact 18 was in contact with contact 20 thereby resetting the flip-flop, the output side of the AND-gate 63 acquires the "H" level, causing the AND-gates 41 and 42 of said correction control gate group 40 to be opened, so that the date and day ae selected as objects for correction. At the same time, as the output of said AND-gate 63 is received by the display control circuit 33, the display portions such as hour, minute and second are deenergized thereby indicating that the date and day are selected as objects for correction, and further the display portions 15 and 16 are turned on to indicate the direction in which the crown should be rotated. As indicated by the display portions 15 and 16, therefore, if the crown 11 under this condition is turned in the direction A, the day is corrected, and if the crown 11 is turned in the direction B, the date is corrected independent of each other.

The day and date can be corrected by the same procedure as illustrated with reference to FIG. 5.

Thereafter, as the crown 11 is pulled out from the second position to the third position, the moving contact 18 comes into contact with the contact pin 19 and the contact pin 19 acquires the "H" level which will set the flip-flop 61. However, since the output terminal of the NOR-gate 36 is now in the "L" level, the output terminal of the AND-gates 62 and 63 also remain in the "L" level. When the contact pin 19 acquires the "H" level, on the other hand, the AND-gates 43 and 44 are enabled, enabling the hour or minute to be corrected while the projection 17*a* is in contact with the contact pin 21 or 22. At the same time, since the AND-gate 35 is also enabled, the second counter can be reset when the switch means $S_3$ is turned on.

Next, if the crown 11 is pushed from the third position to the second position, the moving contact 18 moves to a position at which it comes into contact with neither the contact pin 19 nor the contact pin 20, whereby the output terminal of the NOR-gate 36 acquires the "H" level. In this case, the flip-flop 61 remains in the set state attained when the moving contact was in its third position so that its output terminal Q continues at the "H" level. Therefore, the output terminal of the NOR-gate 36 acquires the "H" level and, at the same time, the output terminal of the AND-gate 62 acquires the "H" level, rendering the AND-gates 45 and 46 of the correction control gate group 40 to be enabled and, as the result, the year and month are selected as objects for correction.

Figure 7:
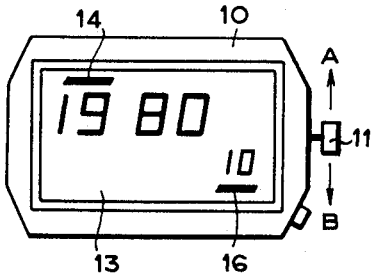
FIG. 7 is a front view of the timepiece equipped with the correcting device of FIG. 6.

At the same time, as the display control circuit 33 receives the output of said AND-gate 62, the display device 13 displays the year and month only as shown in FIG. 7 thereby to indicate that the year and month are selected as objects for correction, and whereby the display portions 14 and 16 are turned on to indicate the direction in which the crown should be turned. That is, the timepiece according to this embodiment is so constructed that the year and month are displayed by the display device 13 only in the state in which the year and month are selected as objects for correction. FIG. 7 shows the state in which the year of 1980 and the month of October are displayed. Under this state, therefore, when the crown 11 is turned in the direction A as indicated by the display portions 14, 16, the year is corrected, and when the crown 11 is turned in the direction B, the month is corrected, each independent of the other. That is, if the projection 17*a* is brought into contact with the contact spring 21, the output end of the AND-gate 45 acquires the "H" level causing the AND-gate 55 to be enabled, so that a 1 Hz correcting signal is introduced to the year counter via AND-gate 55. When the crown 11 is turned in the direction B, the month is corrected in the same manner as mentioned above.

What is claimed is:

1. In a digital display-type electronic timepiece including oscillator circuit means for producing a high frequency time standard signal; frequency divider means for dividing said high frequency time standard signal and producing a low frequency time keeping signal; multi-stage counter means for counting the low frequency time keeping signal, and display means for displaying the data of said counter means; the improvement comprising:

(a) a crown manually actuated from the exterior of said timepiece;

(b) a stem attached to said crown and movable in the axial direction among three preset positions;

(c) axial switching means for producing selection signals to select data of said multi-stage counter means for correction in response to the selective preset position of said stem;

(d) rotary switching means actuated by the rotation of said stem for further selecting from said data selected by said axial switching means selection signals by causing selective transmission of correction signals;

(e) correction circuit means connected to said axial switching means and to said rotary switching means for enabling the correction of said data selected in response to said selection signals from said axial switching means and for correcting said selected data in response to said correction signals;

(f) said axial switching means comprising a pivoted lever, a first fixed contact and a second fixed contact, said pivoted lever movable among three preset lever positions in response to said selective preset position of said stem; and (g) said pivoted lever being in contact with said first fixed contact when said stem is located at a first preset position, and in contact with neither of said first and second fixed contacts when said stem is located at a second preset position, and in contact with said second fixed contact when said stem is located at a third preset position, wherein said axial switching means and said correction means inhibit a counter of said multi-stage counter means from correction when said stem is located at a first preset position.

2. A digital display-type electronic timepiece according to claim 1, further comprising a means for indicating said data selected in response to said selection signal, said means for indicating connected to said axial switching means.

3. A digital display-type electronic timepiece according to claim 1, wherein said correction circuit means is comprised of a plurality of gate means having output terminals connected to said multi-stage counter means.

4. A digital display-type electronic timepiece according to claim 1, wherein said axial switching means further comprises detection gate means connected to said first and second fixed contacts for detecting said stem in said second preset position.

5. A digital-type electronic timepiece according to claim 4, wherein said detection gate means comprises a NOR-GATE.

6. A digital display-type electronic timepiece according to claim 4, wherein said axial switching means further comprises selecting circuit means connected to said first fixed contact, second fixed contact and said detection gate means for producing different selection signals to select different data for correction in response to the preceding preset position from which said stem is moved to said second preset position.

7. A digital display-type electronic timepiece according to claim 6, wherein said selecting circuit means is comprised of an R-S-type flip-flop and first and second gate means, said R-S-type flip-flop being connected to said first and second fixed contacts, and said first and second gate means being connected to the output terminals of said R-S-type flip-flop and said detection gate means, respectively.

8. A digital display-type electronic timepiece according to claim 2, wherein said pivoted lever has a first end located within a radial groove in said stem and a second end disposed between said first and second fixed contacts; and wherein said rotary switching means is comprised of a radial projection located on said stem and a plurality of resilient members radially located about said stem and said projection.

9. A digital display-type electronic timepiece according to claim 3, wherein said axial switching means provides a selection signal to select first and second data for correction, and wherein said rotary switching means causes selective transmission of a first correction signal for accomplishing the correction of said first data when said stem is rotated in a first direction, and selective transmission of a second correction signal for accomplishing the correction of said second data when said first and second data is selectively corrected in response to the rotational direction of said stem.

10. A digital display-type electronic timepiece according to claim 9, wherein said frequency divider means is arranged to provide a low frequency data correcting signal, and said plurality of gate means of said correction circuit means is connected to said frequency divider means correcting said first and second data by passing said low frequency data correcting signal in response to said first and second correction signals.

11. A digital display-type electronic timepiece according to claim 10, wherein said axial switching means selects data of hours and minutes for correction when said stem is located at said third preset position and selects data of dates and days of a week for correction when said stem is located at said second preset position.

12. A digital display-type electronic timepiece according to claim 1, further comprising a push button switch for producing a resetting pulse to reset data of seconds in said multi-stage counter means to zero, and transmitting means transmitting said resetting pulse produced by said push button switch, said transmitting means enabled in response to said selection signal produced by said axial switching means.

* * * * *